US007147005B2

(12) United States Patent
Zucchetti et al.

(10) Patent No.: US 7,147,005 B2
(45) Date of Patent: Dec. 12, 2006

(54) SANITARY DEVICE WITH MECHANICAL SINGLE HOLE MIXER FOR HORIZONTAL TOP

(75) Inventors: Elena Zucchetti, Novara (IT); Matteo Thun, Milan (IT)

(73) Assignee: Zucchetti Rubinetteria S.p.A., Novara (IT)

( * ) Notice: Subject to any disclaimer, the term of this patent is extended or adjusted under 35 U.S.C. 154(b) by 222 days.

(21) Appl. No.: 10/483,288

(22) PCT Filed: Jul. 8, 2002

(86) PCT No.: PCT/EP02/07565

§ 371 (c)(1),
(2), (4) Date: Jan. 9, 2004

(87) PCT Pub. No.: WO03/006754

PCT Pub. Date: Jan. 23, 2003

(65) Prior Publication Data

US 2004/0211475 A1 Oct. 28, 2004

(30) Foreign Application Priority Data

Jul. 13, 2001 (IT) ..... MI20010A1505

(51) Int. Cl.
*E03C 1/02* (2006.01)

(52) U.S. Cl. ..... 137/625.17; 137/801; 137/625.4; 137/359

(58) Field of Classification Search ..... 317/625.4, 317/801, 359, 625.17
See application file for complete search history.

(56) References Cited

U.S. PATENT DOCUMENTS 2,818,878 A * 1/1958 Russell ..... 137/359
3,282,295 A * 11/1966 Skriletz et al. ..... 137/625.17
6,047,722 A 4/2000 Cordes et al.

FOREIGN PATENT DOCUMENTS

EP 0 839 965 5/1998
EP 0 861 946 9/1998

* cited by examiner

*Primary Examiner*—Eric Keasel
*Assistant Examiner*—Craig Schneider
(74) *Attorney, Agent, or Firm*—Young & Thompson

(57) ABSTRACT

A sanitary device with a mechanical single hole (15) mixer (5) for horizontal top (13), said mixer (5) including an axially extended mixer body (17), a mixer cartridge (19), a housing (25) for the mixer cartridge (19) formed within the body (17) of the mixer (5), a water delivery flue pipe (33) and a lever (63) for controling capacity and temperature of the water, characterised in that said mixer body (17) is placed through said hole (15) in said horizontal top (13) and said mixer cartridge (19) is placed at least partially below said top (13) of the mixer (5).

14 Claims, 5 Drawing Sheets

SANITARY DEVICE WITH MECHANICAL SINGLE HOLE MIXER FOR HORIZONTAL TOP

BACKGROUND OF THE INVENTION

The present invention refers to a sanitary device fitted with a mechanical single hole mixer for a horizontal top, such as for example a ceramic or a steel top for a basin, a sink, a bidet etc.

In a sanitary device of this kind the mixer includes a mixer body to be fixed to the top of the sanitary device, a mixer cartridge contained within the body of the mixer, a delivery flue pipe of the mixed water and a free lever that rotates around a vertical and horizontal axle to control the temperature and supply of water.

DESCRIPTION OF THE RELATED ART

In traditional sanitary devices the body of the mixer is visible, that is to say visibly exposed above the relative top and consequently the mixer cartridge is also located above the top of the mixer.

One of the disadvantages of traditional sanitary systems is related to the space occupied by the body of the mixer.

The need to provide a space for fitting of the mixer cartridge does not allow for the space occupied by the body of the mixer to be reduced according to pleasure and this may have negative effects on the possibility of selection of the shape and total dimensions of the mixer.

For example the minimum projection of the mixer from the top is equal to the projection of the body of the mixer.

The space occupied by the body of the mixer may create areas of the sanitary device with a reduced level of accessibility with regards to cleaning and maintenance operations.

Furthermore, the design of the mixer body and the rest of the mixer must be in perfect harmonization so as not to create aesthetic imperfections.

SUMMARY OF THE INVENTION

The objective of the present invention is to provide a sanitary device fitted with a mechanical single hole mixer for a horizontal top in which the body of the mixer does not create an obstruction for cleaning and maintenance of the sanitary device and therefore is not so bulky as to limit the project choices relative to the shape and total dimensions of the mixer.

Another objective of the present invention is to provide a sanitary device fitted with a mechanical single hole mixer for a horizontal top in which the mixer cartridge occupies a completely protected position.

Another objective of the present invention is to provide a sanitary device with a mechanical single hole mixer for a horizontal top in which the components of the mixer are easy to replace.

These objectives are achieved by a sanitary device with a mechanical single hole mixer for horizontal top, said mixer including an axially extended mixer body, a mixer cartridge, a housing for the mixer cartridge formed within the body of the mixer, a water delivery flue pipe and a lever for controling capacity and temperature of the water, characterised in that said mixer body is placed through said hole in said horizontal top and said mixer cartridge is placed at least partially below said top of the mixer.

Preferably said mixer body includes: a central portion of the mixer body; a bottom portion of the mixer body; a head portion of the mixer body; means formed into the bottom portion of the mixer body for feeding warm and respectively hot load water to a warm and respectively hot water inlet of the mixer cartridge; and means for feeding a mixed water delivered from the mixer cartridge to a delivery outlet for the mixed water formed partially into said bottom portion, partially into said central portion and partially into said head portion of the mixer body for delivering said mixed water to said delivery flue pipe.

Preferably said central portion and bottom portion are axially registrable with said hole of the horizontal top and are placed on an inner side of said hole of the horizontal top, and said head portion is axially unregistrable with said hole of the horizontal top and is placed on an outer side of the hole of the horizontal top.

Preferably said head portion is flattened and enlarged in respect of said central and bottom portion.

Preferably said housing for said mixer cartridge is in form of a shell opened on said head portion and axially extended through said head portion and said central portion.

Preferably said warm and respectively hot water inlet of the mixer cartridge open on a bottom of said shell, and said delivery outlet for the mixed water delivered from the mixer cartridge for delivering said mixed water to said delivery flue pipe also opens on said bottom of said shell.

Preferably a covering element of the head of the mixer body is provided for.

In a first preferred embodiment said delivery flue tube is made in one single piece with said covering element of the head portion of the mixer body.

In a second preferred embodiment said delivery flue tube is detachably secured to said covering element of the head portion of the mixer body.

Preferably in said second preferred embodiment snap engaging means are provided between said delivery flue tube and said covering element of the head portion of the mixer body.

Preferably said snap engaging means comprise a tubular male fitting fixed to said mixed water outlet conduit from the mixer body and a female tubular fitting fixed internally to the delivery flue tube.

Preferably said male fitting comprises at least one circumferential external groove and an open elastic ring housed in said circumferential external groove, and said female fitting comprises at least one circumferential internal groove registrable with said open elastic ring of said circumferential external groove of the male fitting.

Thanks to the introduction of the mixer body through the hole in the horizontal top and to the position of the mixer cartridge at least partially below the horizontal top, the part of the mixer body protruding above the horizontal top can be advantageously reduced according to pleasure.

Furthermore, with this layout of the mixer all inspection and cleaning operations of the visible parts of the sanitary device are much easier, the mixer cartridge occupies a much more protected position and the body of the mixer can also not carry out an aesthetic function as it can be almost completely hidden below the relative top.

The covering element for the head portion of the mixer body may have such a shape to cover completely the head portion of the mixer body in such a way that the mixer body is definitely freed from any aesthetic function.

These and other aspects will be clarified in the following descriptions in a preferred manner to carry out the invention, to be purely considered as an example not limiting the general principle claimed.

BRIEF DESCRIPTION OF THE DRAWINGS

The following description refers to the drawings attached, in which.

DESCRIPTION OF THE PREFERRED EMBODIMENT

Figure 1:
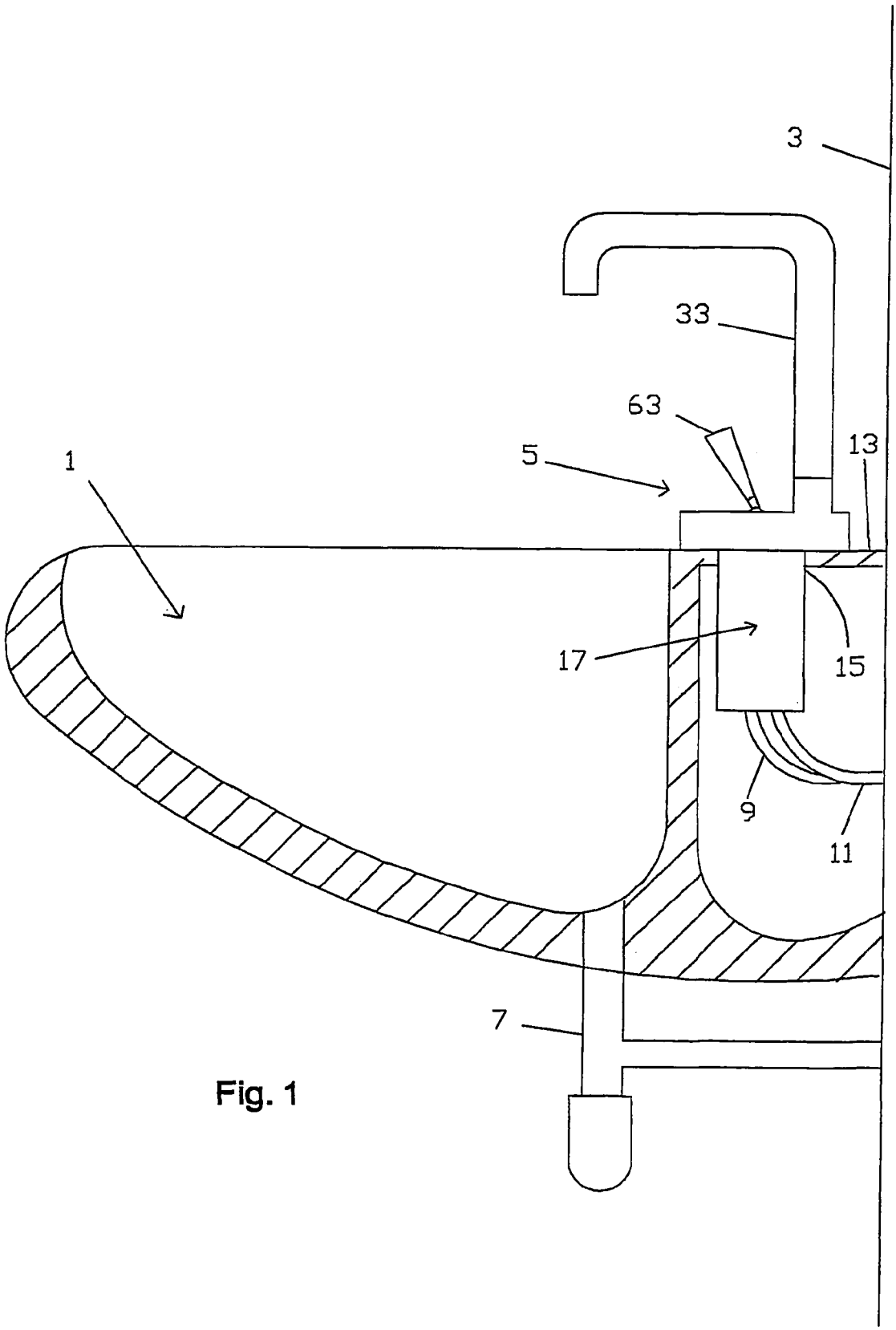
FIG. 1 is a partial sectional view in an elevated side of the creation of a sanitary device according to the present invention.

With reference to FIG. 1, the sanitary device includes a wall mounted 3 sink 1 and a mechanical single hole mixer for a horizontal top, generally indicated with 5.

The sink 1 has a hydraulic connection 7 to the drain water system, while the mixer 5 has connections 9 and 11 to the hot and cold water system.

The sink 1 defines a horizontal top 13 fitted with a circular hole 15 for fixing of the mixer 5.

Figure 2:
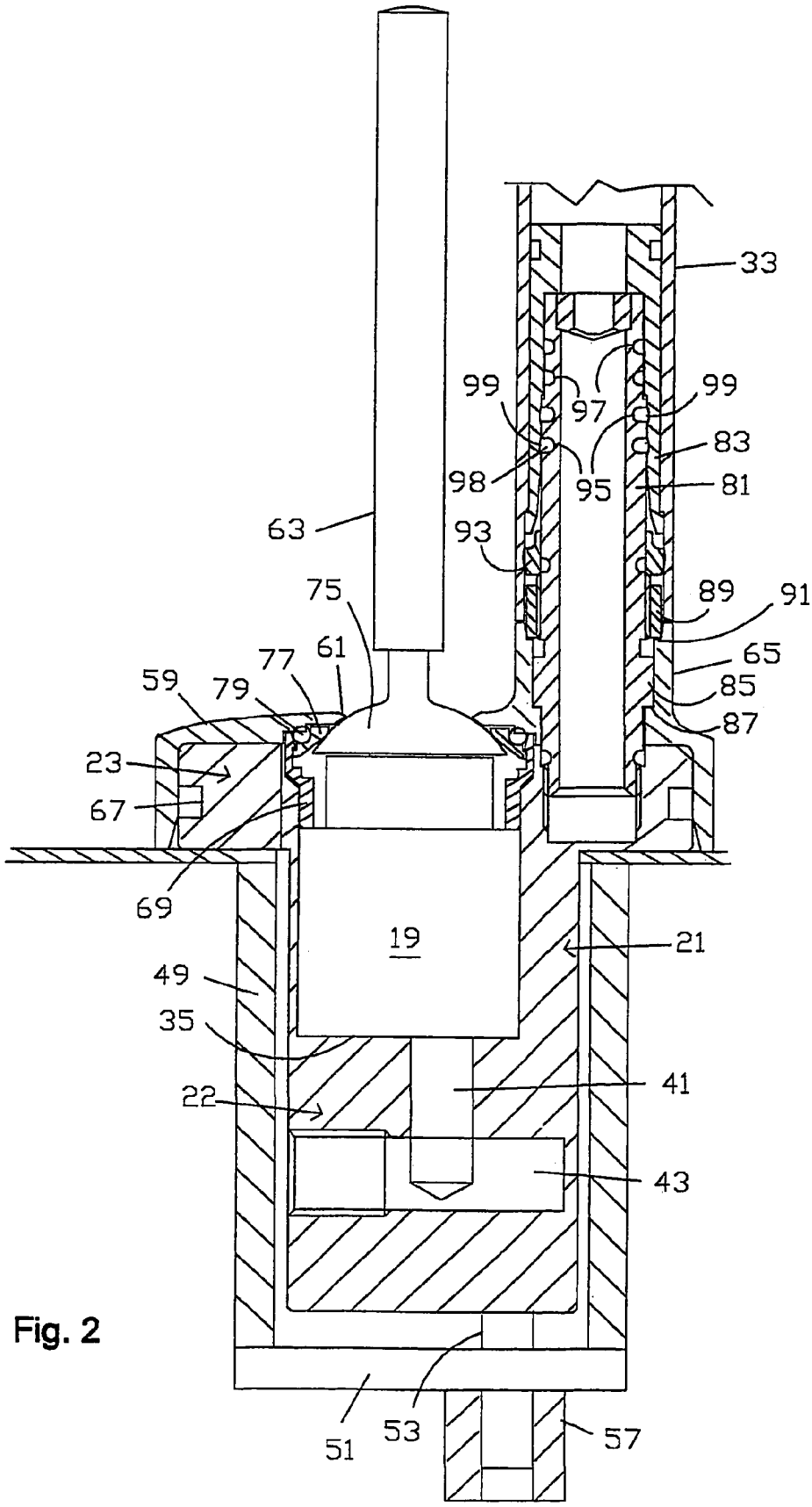
FIG. 2 is an elevated side view of a possible embodiment of a mixer according to the present invention in which the mixer is dissected according to the line 5—5 of FIG. 4 and, furthermore, in which the fixing system of the mixer of the sanitary device is shown.
Figure 3:
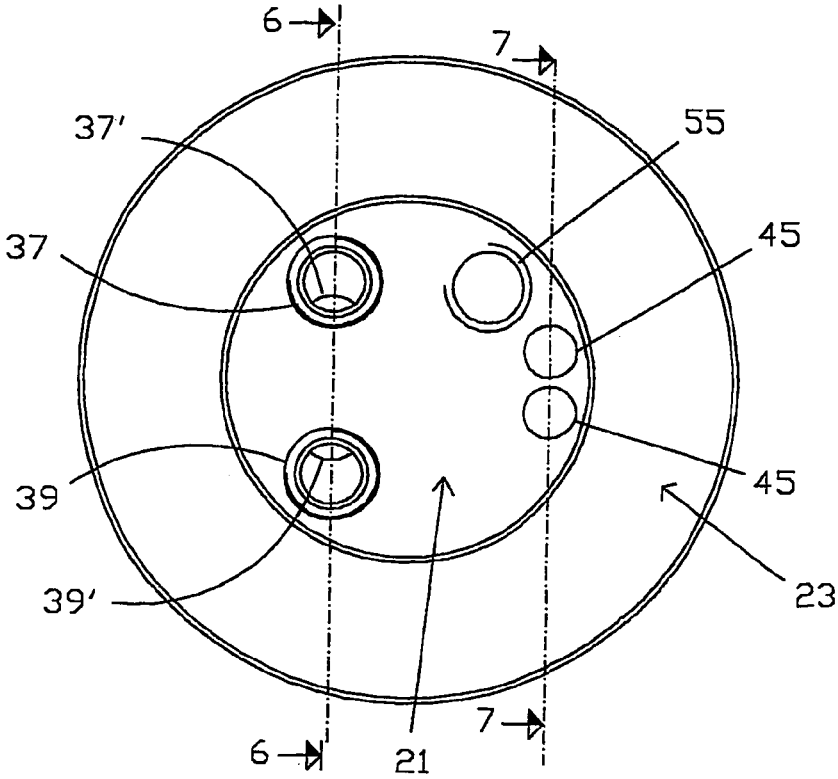
FIG. 3 is a diagrammatic view from the bottom of the body of the mixer of FIG. 2.

With reference to FIG. 2, the mixer 5 includes a mixer body 17 extended along a main central axis L—L.

The body of the mixer 17 presents a central cylindrical portion 21 and a cylindrical bottom portion 22 both having a diameter slightly smaller than the diameter of the hole 15 of the top 13, and a cylindrical head portion 23 radially enlarged and flattened in respect of the central portion 21.

The central portion 21 and the bottom portion 22 of the body of the mixer 17 are inserted into the hole 15 of the top 13 from the top and completely occupy the inner hidden side of the top 13, while the head portion 23 rests on the walls of the hole 15 of the top 13 from the visible top side of the top itself 13.

With reference now to FIGS. 4 to 7, in the mixer body 17 a housing shell 25 for a mixer cartridge 19 axially extends through the head porton 23 and the central portion 21 of the mixer body 17.

In the bottom portion 22 of the mixer body 17 a first hydraulic connection is provided between inlets of hot and cold load water to the body of the mixer 17 and inlets of hot and cold load water to the mixer cartridge 19, and a second hydraulic connection is provided through the bottom portion 22, the central portion 21 and the head portion 23 between a mixed water outlet of the mixer cartridge 19 and a delivery outlet of the body of the mixer 17.

The inlets of warm and cold water to the mixer cartridge 19 and the outlet of the mixed water from the mixer cartridge 19 are provided on the bottom surface 35 of the housing shell 25 for the mixer cartridge 19.

The first hydraulic connection includes a first 37 and respectively second 39 vertical inlet conduits which extend eccentricly from the base of the bottom portion 22 of the mixer body 17 and are fitted in a slightly misaligned manner to a corresponding first 37' and respectively second 39' vertical conduit of entrance of hot and cold water to the mixer cartridge 19 which in turn extend from the bottom surface 35 of the housing shell 25 of the mixer cartridge 19.

The second hydraulic connection includes in sequence: a vertical outlet conduit 41 from the cartridge 19 which opens from the bottom surface 35 of the housing shell 25 of the cartridge mixer 19; a horizontal conduit 43, communicating directly with the vertical conduit 41, which develops between the two conduits 37 and 39 of the first hydraulic connection beyond the vertical limit of the housing shell 25; a pair of approached vertical conduits 45, 45 with a reduced cross-section that communicate directly with the horizontal conduit 43 and are fed in parallel by the horizontal conduit 43, and which extend upwards through the central portion 21 of the mixer body 17 alongside the housing shell 25; and a vertical outlet conduit 47 that extends from the upper surface of the head portion 23 of the mixer body 17 and is fitted in a slightly misaligned manner to each of the conduits 45, 45 along a intersection section sufficient to create a suitable passage of water.

The layout of the first and second hydraulic connections made into the mixer body 17 is particularly advantageous as it allows for the creation of a mixer body 17 which is extremely compact and that supports a good capacity of water.

It is necessary to underline that the layout of the mixer body 17 through the hole 15 of the relative support 13 may be created without extending or modifying the shape of the hole 15, of a shape and dimension universally recognised, but adapting the structure to the body of the mixer 17.

In order to guarantee a good capacity compatible with the demands for compactness of the mixer body 17, the breakdown of the capacity on two vertical conduits 45, 45 of a reduced section fed in parallel turned out to be very advantageous.

In the case, however, one would modify the shape and dimension of the hole 15 according to pleasure, also the shape and dimension of the mixer body 17 may be adapted to those of the hole 15.

FIG. 2 also illustrates a possible method of blocking the mixer body 17 to the sink 1. For this objective an axially open ferrule 49 inserted into the central portion 21 of the mixer body 17 and resting on the internal side of the wall of the hole 15 of the top 13 is provided for.

There is a fork 51 resting on the free end of the ferrule 49 fitted with a through hole through which a threaded dowel 53 can be found to be screwed to a threaded blind hole 55 of the base of the mixer body 17, which threaded dowel has a clamping bolt 57 which must be clamped to the fork 51 to block the mixer body 17 to the sink 1 and loosened to remove the mixer body from the sink 1.

With reference again to FIG. 2, the mixer 5 includes a rosette 59 applied to cover the head 23 of the mixer body 17.

The rosette 59 has the lower end which is completely open for insertion of the head portion 23 of the mixer body 17 and the upper end fitted with a passage 61 for a control lever 63 of the cartridge 19 and a tubular extension 65 which is axially open and in line with the outlet conduit 47 from the body mixer 17.

The rosette 59 is applied with pressure to the head portion 23 of the mixer body 17 and the pressure of contact between the two parts is assured by an annular washer (not shown) protruding from a relative housing 67 grooved along a circumference of the external side wall of the head portion 23.

The base of the cartridge 19 is kept firmly in contact with the bottom surface 35 of the shell 25 of the mixer body 17 through the pressure applied to the mixer cartridge 19 by a ring nut 69 centred above the mixer cartridge 19 and fixed into a recess 71 which opens up onto the upper surface of the head portion 23 of the mixer body 17.

Figure 4:
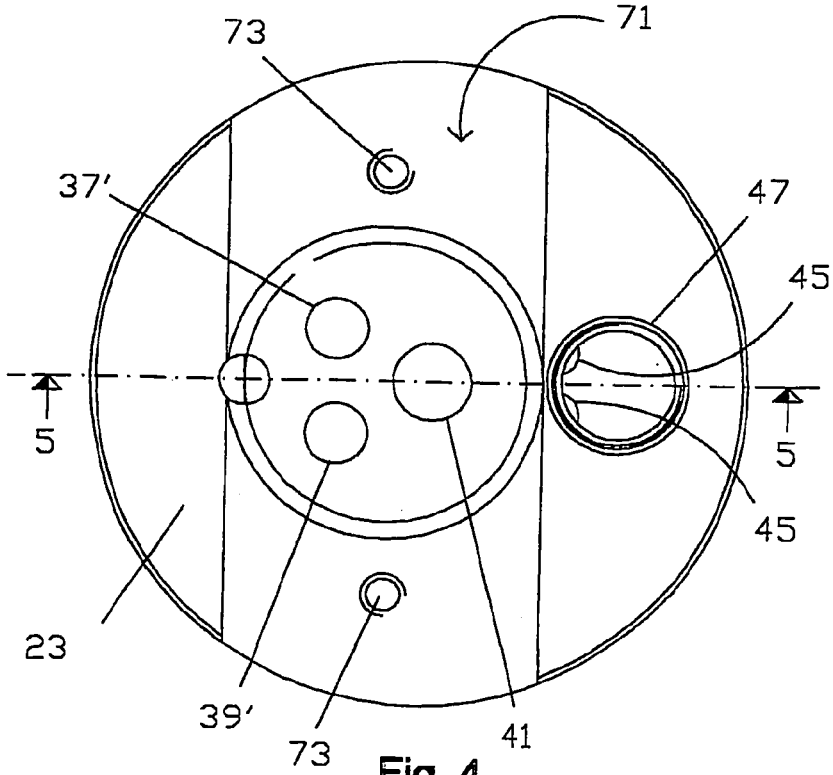
FIG. 4 is a diagrammatic view from the top of the body of the mixer of FIG. 2.
Figure 5:
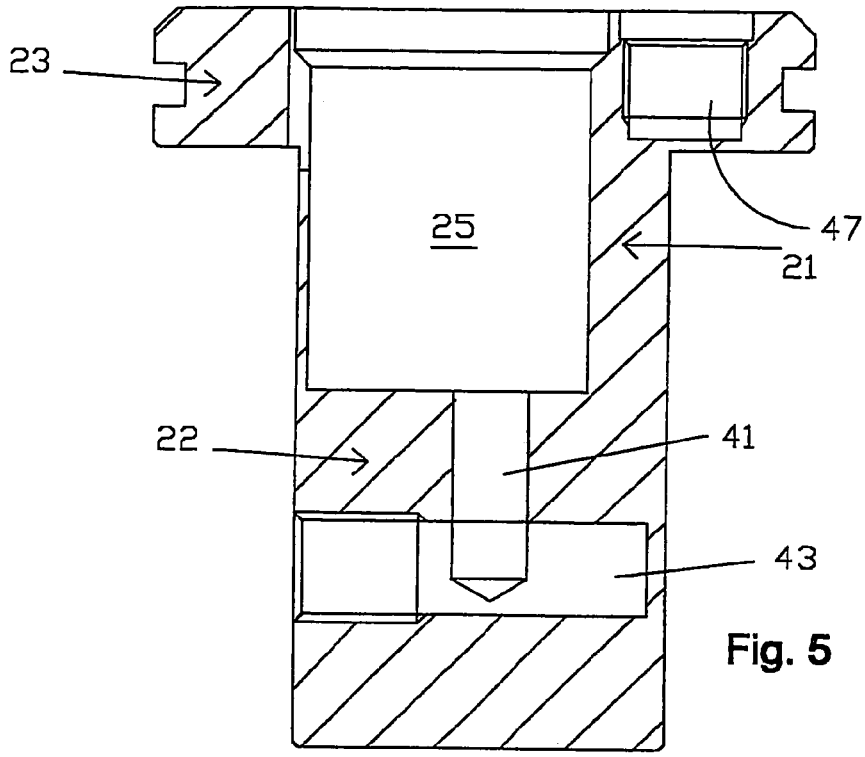
FIG. 5 is an elevated side view of the body of the mixer of FIG. 2, dissected along the line 5—5 of FIG. 4.
Figure 6:
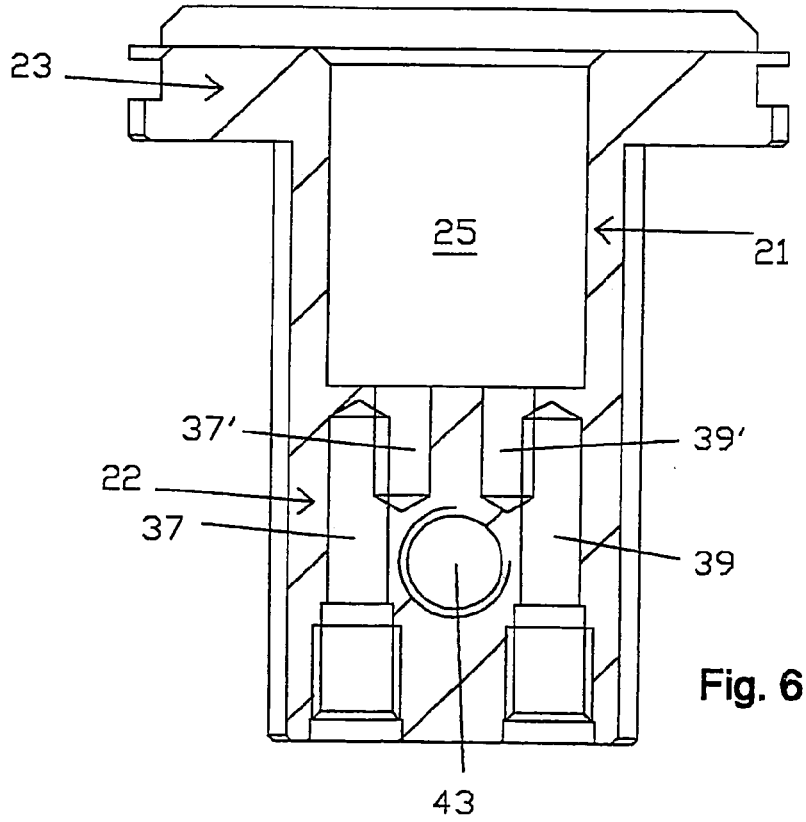
FIG. 6 is an elevated side view of the body of the mixer of FIG. 2 dissected along the line 6—6 of FIG. 3.
Figure 7:
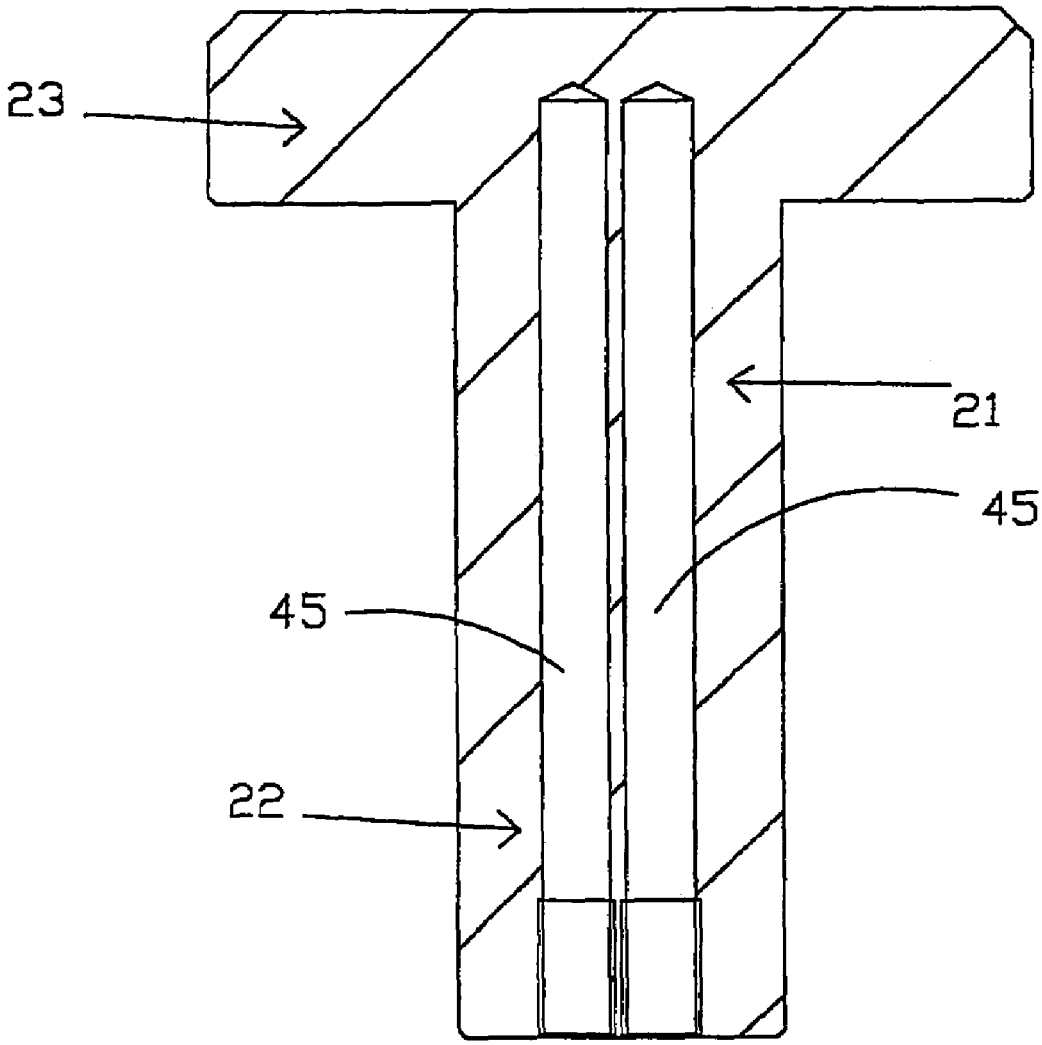
FIG. 7 is an elevated side view of the body of the mixer of FIG. 2 dissected along the line 7—7 of FIG. 3.

FIG. 4 illustrates in detail the holes 73 of the recess 71 for fixing of the ring nut 69 using screws.

Going back to FIG. 2, the end of the lever 63 inside the rosette 59 is extended with a semi spherical cap 75 that supports an annular washer 77, and said annular washer 77 is held between the semi spherical cap 75 and the rosette 59 and is used as a sealing element with regards to the entrance of drops of water from the passage 61 of the rosette 59 provided for the lever 63 and as a bearing for sliding of the semi spherical cap 75 of the lever 63.

The upper side of the annular washer 77 has a second annular washer 79, interposed between the first washer 77 and the rosette 59, which is used to maintain contact pressure between the rosette 59 and the first annular washer 77 compensating for any possible constructive tolerance.

Between the delivery flue tube 33 and the tubular extension 65 of the rosette 59 there is a rapid attachment system which includes a male tubular fitting axially open 81 fixed internally to the tubular extension 65 of the rosette 59 and extending beyond it, and a female tubular fitting axially open 83 fixed, for example welded, internally to the piece of delivery tube 33 to be hooked to the rosette 59.

The male fitting 81 has an annular external protrusion 85 verifiable with an annual internal shoulder 87 of the tubular extension 65 of the rosette 59, and has an external axial end threaded which penetrates and can be screwed into the conduit 47, also threaded internally, right up to the point in which the protrusion 85 of the male fitting reaches the shoulder 87 of the tubular extension 65 of the rosette 59 in such a way as to firmly secure the rosette 59 to the head portion 23 of the mixer body 17.

External to the male fitting 81 there is a threaded counter ferrule 89 clamped against a limit stop 91 formed at the internal side of the tubular extension 65 of the rosette 59 in order to prevent unscrewing of the male fitting 81.

Between the male fitting 81 and the delivery tube 33 there is a bearing 93 aimed at eliminating the possibility of clearance between the two parts.

On its external surface the male fitting 81 has a pair of annular grooves 95 containing open elastic rings 98, and said grooves 95 in the male fitting 81 can face to corresponding internal grooves 97 of the female fitting 83 in such a way as to allow for radial dilatation of the open rings in the grooves 97 of the female fitting 83 and the consequent hooking between the parts. The unhooking process comes about thanks to retraction of the open rings inside the grooves 95 of the male fitting 81 induced by applying a relative traction between the two engaged parts.

The male fitting 81 has finally a second pair of external annular grooves 99 placed above the first pair of annular grooves 95 of the open rings, for supporting of the annular gaskets of hydraulic seal between the male fitting 81 and the female fitting 83.

The rapid attachment system is extremely convenient as it makes the delivery tube 33 interchangeable according to pleasure with extreme ease by the user.

Other attachment systems of the delivery tube can be provided for, for example based on screw fixing between the delivery tube and the base, which however do not achieve the same level of practicality as the rapid attachment system described.

Alternatively, it is conceivable that the delivery tube and the base are made from one single piece.

The present invention provides a single control support mixer with the mixer body inserted through the support hole of the top of a sanitary device and the mixer cartridge at least partially below the above-mentioned support top.

The invention can be clearly extended to mixers for sanitary systems in ceramic, glass or stainless steel and mixers for use in kitchens or bathrooms, for example for sinks, basins, bidets etc.

The invention claimed is:

1. A sanitary device with a mechanical single hole (15) mixer (5) for horizontal top (13), said mixer (5) including an axially extended mixer body (17) having a central portion (21), a bottom portion (22), and a head portion (23), a mixer cartridge (19), a housing (25) for the mixer cartridge (19) formed within the body (17) of the mixer (5), a water delivery flue pipe (33) and a lever (63) for controlling capacity and temperature of the water, characterised in that said central portion (21) and said bottom portion (22) are axially registrable with said hole (15) of the horizontal top (13) and are placed on an inner side of said hole (15) of the horizontal top (13), in that said head portion (23) is axially unregistrable with said hole (15) of the horizontal top (13) and is placed on an outer side of the hole (15) of the horizontal top (13), so that said mixer body (17) is placed through a hole (15) in said horizontal top (13) and said mixer cartridge (19) is placed at least partially below said horizontal top (13).

2. A sanitary device with a mechanical mixer (5) according to claim 1, characterised in that said mixer body (17) includes:

means (37, 37', 39, 39') formed into the bottom portion (22) of the mixer body (17) for feeding warm and respectively hot load water to a warm and respectively hot water inlet of the mixer cartridge (19); and means (41, 43, 45, 45, 47) for feeding a mixed water delivered from the mixer cartridge (19) to a delivery outlet for the mixed water formed partially into said bottom portion (22), partially into said central portion (21) and partially into said head portion (23) of the mixer body (17) for delivering said mixed water to said delivery flue pipe (33).

3. A sanitary device with a mechanical mixer (5) according to claim 2, characterised in that it includes a covering element (59) of the head portion (23) of the mixer body (17).

4. A sanitary device with a mechanical mixer (5) according to claim 3, characterised in that said delivery flue tube (33) is detachably secured to said covering element (59) of the head portion (23) of the mixer body (17).

5. A sanitary device with a mechanical mixer (5) according to claim 4, characterised in that snap engaging means are provided between said delivery flue tube (33) and said covering element (59) of the head portion (23) of the mixer body (17).

6. A sanitary device with a mechanical mixer (5) according to claim 5, characterised in that said snap engaging means comprise a tubular male fitting (81) fixed to said mixed water outlet conduit from the mixer body (17) and a female tubular fitting (83) fixed internally to the delivery flue tube (33).

7. A sanitary device with a mechanical mixer (5) according to claim 6 characterised in that said male fitting (81) comprises at least one circumferential external groove (95) and an open elastic ring (98) housed in said circumferential external groove (95), and said female fitting (83) comprises at least one circumferential internal groove (99) registrable with said open elastic ring (98) of said circumferential external groove (95) of the male fitting (81).

8. A sanitary device with a mechanical mixer (5) according to claim 3, characterised in that said delivery flue tube (33) is made in one single piece with said covering element (59) of the head portion (23) of the mixer body (17).

9. A sanitary device with a mechanical mixer (5) according to claim 2, characterised in that said housing (25) for said mixer cartridge is in form of a shell (25) opened on said head portion (23) and axially extended,through said head portion (23) and said central portion (21).

10. A sanitary device with a mechanical mixer (5) according to claim 9, characterised in that said warm and respectively hot water inlet of the mixer cartridge open on a bottom (35) of said shell (25), and in that said delivery outlet for the mixed water delivered from the mixer cartridge (19) for delivering said mixed water to said delivery flue pipe (33) also open on said bottom (35) of said shell (25).

11. A sanitary device with a mechanical mixer (5) according to claim 1, characterised in that said head portion (23) is enlarged in respect of said central (21) and bottom (22) portion.

12. A sanitary device with a mechanical mixer (5) according to claim 11, characterised in that said head portion (23) is flattened.

13. A sanitary device with a mechanical single hole (15) mixer (5) for horizontal top (13), said mixer (5) including an axially extended mixer body (17), a mixer cartridge (19), a housing (25) for the mixer cartridge (19) formed within the body (17) of the mixer (5), a water delivery flue pipe (33). and a lever (63) for controlling capacity and temperature of the water, characterised in that said mixer body (17) is placed through a hole (15) in said horizontal top (13) and said mixer cartridge (19) is placed at least partially below said horizontal top (13), said mixer body (17) includes:

a central portion (21) of the mixer body (17);

a bottom portion (22) of the mixer body (17);

a head portion (23) of the mixer body (17);

means (37, 37', 39, 39') formed into the bottom portion (22) of the mixer body (17) for feeding warm and respectively hot load water to a warm and respectively hot water inlet of the mixer cartridge (19); and means (41, 43, 45, 45, 47) for feeding a mixed water delivered from the mixer cartridge (19) to a delivery outlet for the mixed water formed partially into said bottom portion (22), partially into said central portion (21) and partially into said head portion (23) of the mixer body (17) for delivering said mixed water to said delivery flue pipe (33), said housing (25) for said mixer cartridge is in form of a shell (25) opened on said head portion (23) and axially extended through said head portion (23) and said central portion (21), and said warm and respectively hot water inlet of the mixer cartridge open on a bottom (35) of said shell (25), and in that said delivery outlet for the mixed water delivered from the mixer cartridge (19) for delivering said mixed water to said delivery flue pipe (33) also open on said bottom (35) of said shell (25).

14. A sanitary device with a mechanical single hole (15) mixer (5) for horizontal top (13), said mixer (5) including an axially extended mixer body (17), a mixer cartridge (19), a housing (25) for the mixer cartridge (19) formed within the body (17) of the mixer (5), a water delivery flue pipe (33) and a lever (63) for controlling capacity and temperature of the water, characterised in that said mixer body (17) is placed through a hole (15) in said horizontal top (13) and said mixer cartridge (19) is placed at least partially below said horizontal top (13), said mixer body (17) includes:

a central portion (21) of the mixer body (17);

a bottom portion (22) of the mixer body (17);

a head portion (23) of the mixer body (17);

means (37, 37', 39, 39') formed into the bottom portion (22) of the mixer body (17) for feeding warm and respectively hot load water to a warm and respectively hot water inlet of the mixer cartridge (19); and means (41, 43, 45, 45, 47) for feeding a mixed water delivered from the mixer cartridge (19) to a delivery outlet for the mixed water formed partially into said bottom portion (22), partially into said central portion (21) and partially into said head portion (23) of the mixer body (17) for delivering said mixed water to said delivery flue pipe (33), and said delivery flue tube (33) is made in one single piece with a covering element (59) of the head portion (23) of the mixer body (17).

* * * * *